US012318882B2

(12) United States Patent
Chang et al.

(10) Patent No.: US 12,318,882 B2
(45) Date of Patent: Jun. 3, 2025

(54) APPARATUS AND METHOD FOR CMP TEMPERATURE CONTROL

(71) Applicant: Applied Materials, Inc., Santa Clara, CA (US)

(72) Inventors: Shou-Sung Chang, Mountain View, CA (US); Hari Soundararajan, Sunnyvale, CA (US); Haosheng Wu, San Jose, CA (US); Jianshe Tang, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 18/452,062

(22) Filed: Aug. 18, 2023

(65) Prior Publication Data

US 2023/0415296 A1 Dec. 28, 2023

Related U.S. Application Data

(63) Continuation of application No. 16/795,103, filed on Feb. 19, 2020.

(60) Provisional application No. 62/808,266, filed on Feb. 20, 2019.

(51) Int. Cl.
*B24B 37/015* (2012.01)

(52) U.S. Cl.
CPC ..... *B24B 37/015* (2013.01)

(58) Field of Classification Search
CPC ..... B24B 7/228; B24B 37/005; B24B 37/04; B24B 37/015; B24B 37/07; B24B 37/042; B24B 37/10; B24B 37/105; B24B 37/107; B24B 37/34; B24B 55/02; B24B 55/12; B24B 57/02
See application file for complete search history.

(56) References Cited

U.S. PATENT DOCUMENTS

| | | | |
|---|---|---|---|
| 4,450,652 | A | 5/1984 | Walsh |
| 4,919,232 | A | 4/1990 | Lofton |
| 5,088,242 | A | 2/1992 | Lubbering et al. |
| 5,196,353 | A | 3/1993 | Sandhu et al. |
| 5,478,435 | A | 12/1995 | Murphy et al. |
| 5,597,442 | A | 1/1997 | Chen et al. |
| 5,643,050 | A | 7/1997 | Chen |

(Continued)

FOREIGN PATENT DOCUMENTS

| | | |
|---|---|---|
| CN | 2206182 | 8/1995 |
| CN | 1934208 | 3/2007 |

(Continued)

OTHER PUBLICATIONS

Office Action in Japanese Appln. No. 2021-547703, dated Jan. 30, 2024, 8 pages (with English translation).

(Continued)

*Primary Examiner* — Joel D Crandall
(74) *Attorney, Agent, or Firm* — Fish & Richardson P.C.

(57) ABSTRACT

A chemical mechanical polishing apparatus includes a platen to hold a polishing pad, a carrier to hold a substrate against a polishing surface of the polishing pad during a polishing process, and a temperature control system including a source of a fluid medium and one or more openings positioned over the platen and separated from the polishing pad and configured for the fluid medium to flow onto the polishing pad to heat or cool the polishing pad.

9 Claims, 3 Drawing Sheets

(56) References Cited

U.S. PATENT DOCUMENTS 5,709,593 A 1/1998 Guthrie
5,722,875 A 3/1998 Iwashita et al.
5,738,574 A 4/1998 Tolles et al.
5,762,544 A 6/1998 Zuniga et al.
5,765,394 A 6/1998 Rhoades
5,851,135 A 12/1998 Sandhu et al.
5,851,846 A 12/1998 Matsui et al.
5,868,003 A 2/1999 Simas et al.
5,873,769 A 2/1999 Chiou et al.
5,893,753 A 4/1999 Hempel, Jr.
5,957,750 A 9/1999 Brunelli
6,000,997 A 12/1999 Kao et al.
6,012,967 A * 1/2000 Satake ..... B24B 57/02 451/6
6,023,941 A 2/2000 Rhoades
6,095,898 A 8/2000 Hennofer et al.
6,121,144 A 9/2000 Marcyk et al.
6,151,913 A 11/2000 Lewis et al.
6,159,073 A 12/2000 Wiswesser et al.
6,257,954 B1 7/2001 Ng et al.
6,257,955 B1 7/2001 Springer et al.
6,264,789 B1 7/2001 Pandey et al.
6,280,289 B1 8/2001 Wiswesser et al.
6,315,635 B1 11/2001 Lin
6,319,098 B1 11/2001 Osterheld et al.
6,399,501 B2 6/2002 Birang et al.
6,402,597 B1 6/2002 Sakura et al.
6,422,927 B1 7/2002 Zuniga
6,461,980 B1 10/2002 Cheung et al.
6,494,765 B2 12/2002 Gitis et al.
6,503,131 B1 1/2003 Franklin et al.
6,543,251 B1 4/2003 Gasteyer, III et al.
6,640,151 B1 10/2003 Somekh et al.
6,647,309 B1 11/2003 Bone
6,776,692 B1 8/2004 Zuniga et al.
6,829,559 B2 12/2004 Bultman et al.
6,887,132 B2 5/2005 Kajiwara et al.
6,896,586 B2 5/2005 Pham et al.
6,899,592 B1 5/2005 Kojima et al.
7,008,295 B2 3/2006 Wiswesser et al.
7,016,750 B2 3/2006 Steinkirchner et al.
7,189,140 B1 3/2007 Shugru et al.
7,196,782 B2 3/2007 Fielden et al.
7,201,634 B1 4/2007 Naujok et al.
7,234,224 B1 6/2007 Naugler et al.
7,822,500 B2 10/2010 Kobayashi et al.
8,133,756 B2 3/2012 Park et al.
8,172,641 B2 5/2012 Ho et al.
8,349,247 B2 1/2013 Ueno
8,398,463 B2 3/2013 Bajaj
8,439,723 B2 5/2013 Marks et al.
8,740,667 B2 6/2014 Kodera et al.
8,845,391 B2 9/2014 Sone et al.
8,871,644 B2 10/2014 Matsui et al.
9,005,999 B2 4/2015 Xu et al.
9,067,296 B2 6/2015 Ono et al.
9,475,167 B2 10/2016 Maruyama et al.
9,539,699 B2 1/2017 Shinozaki
9,579,768 B2 2/2017 Motoshima et al.
9,630,295 B2 4/2017 Peng et al.
9,782,870 B2 10/2017 Maruyama et al.
10,035,238 B2 7/2018 Maruyama et al.
10,086,543 B2 10/2018 Cantrell
11,103,970 B2 8/2021 Huang et al.
11,597,052 B2 3/2023 Soundararajan et al.
11,951,589 B2 4/2024 Zhang et al.
2001/0021625 A1 9/2001 Inoue et al.
2001/0055940 A1 12/2001 Swanson
2002/0039874 A1 4/2002 Hecker et al.
2002/0058469 A1 5/2002 Pinheiro et al.
2002/0065002 A1 5/2002 Handa et al.
2002/0065022 A1 5/2002 Iwasaki et al.
2002/0068454 A1 6/2002 Sun et al.
2003/0055526 A1 3/2003 Avanzino et al.
2003/0148615 A1 8/2003 Chung et al.
2003/0211816 A1 11/2003 Liu et al.
2004/0087248 A1 5/2004 Hirokawa
2004/0097176 A1 5/2004 Cron
2005/0024047 A1 2/2005 Miller et al.
2005/0042877 A1 2/2005 Salfelder et al.
2005/0181709 A1 8/2005 Jiang et al.
2005/0211377 A1 9/2005 Chen et al.
2006/0205323 A1 9/2006 Togawa et al.
2007/0035020 A1 2/2007 Umemoto
2007/0135020 A1 6/2007 Nabeya
2007/0205112 A1 9/2007 Kodera et al.
2007/0227901 A1 10/2007 Hu et al.
2007/0238395 A1 10/2007 Kimura et al.
2008/0132152 A1 6/2008 Kiesel et al.
2008/0311823 A1 12/2008 Aiuoshizawa et al.
2009/0258573 A1 10/2009 Muldowney et al.
2010/0047424 A1 2/2010 Cousin et al.
2010/0081360 A1 4/2010 Xu et al.
2010/0203806 A1 8/2010 Kitakura et al.
2010/0227435 A1 9/2010 Park et al.
2010/0279435 A1 11/2010 Xu et al.
2011/0081832 A1* 4/2011 Nakamura ..... B24B 57/02 451/28
2011/0159782 A1 6/2011 Sone et al.
2012/0034846 A1 2/2012 Minamihaba et al.
2012/0040592 A1 2/2012 Chen et al.
2012/0190273 A1* 7/2012 Ono ..... B24B 37/10 451/5
2012/0220196 A1 8/2012 Maruyama et al.
2013/0023186 A1 1/2013 Motoshima et al.
2013/0045596 A1 2/2013 Eda et al.
2013/0210173 A1 8/2013 Wu et al.
2013/0331005 A1 12/2013 Akifumi et al.
2014/0024297 A1 1/2014 Cahndraeskaran et al.
2014/0187122 A1 7/2014 Ishibashi
2014/0251952 A1 9/2014 Bajaj et al.
2014/0315381 A1 10/2014 Wang et al.
2014/0323017 A1 10/2014 Tang et al.
2015/0024661 A1 1/2015 Peng et al.
2015/0079881 A1 3/2015 Maruyama et al.
2015/0196988 A1 7/2015 Watanabe
2015/0224621 A1 8/2015 Motoshima et al.
2015/0224623 A1 8/2015 Xu et al.
2016/0167195 A1 6/2016 Diao et al.
2016/0236318 A1 8/2016 Choi et al.
2017/0232572 A1 8/2017 Brown
2017/0232574 A1 8/2017 Kim et al.
2017/0301573 A1 10/2017 Shibuya et al.
2017/0361419 A1 12/2017 Elkhatib et al.
2018/0222007 A1* 8/2018 Motoshima ..... B24B 37/015
2018/0236631 A1 8/2018 Eto et al.
2018/0290263 A1 10/2018 Sotozaki et al.
2018/0337068 A1 11/2018 Ota et al.
2019/0126428 A1 5/2019 Martuyama et al.
2019/0143476 A1 5/2019 Wu
2019/0143477 A1 5/2019 Baba et al.
2019/0242644 A1 8/2019 Kim
2020/0001425 A1 1/2020 Huang
2020/0001426 A1 1/2020 Soundararajan et al.
2020/0001427 A1 1/2020 Soundararajan et al.
2020/0262024 A1 8/2020 Chang et al.
2021/0046602 A1 2/2021 Wu et al.
2021/0046603 A1 2/2021 Wu et al.
2021/0046604 A1 2/2021 Wu et al.
2021/0402555 A1 12/2021 Kumar et al.
2024/0066660 A1 2/2024 Wu et al.

FOREIGN PATENT DOCUMENTS

CN 1970232 5/2007
CN 101209528 7/2008
CN 101500721 8/2009
CN 102175064 9/2011
CN 102179757 9/2011
CN 102419603 4/2012
CN 102528651 7/2012
CN 103708714 4/2014
CN 103934747 7/2014
CN 107097145 8/2017

(56) References Cited

FOREIGN PATENT DOCUMENTS

| | | | |
|---|---|---|---|
| CN | 107696361 | | 2/2018 |
| CN | 207171777 | | 4/2018 |
| CN | 109719615 | | 5/2019 |
| EP | 2532478 | | 12/2012 |
| JP | H07-040232 | | 2/1995 |
| JP | H10-321570 | | 12/1998 |
| JP | H11-033897 | | 2/1999 |
| JP | H 11-277410 | | 10/1999 |
| JP | 2001-060725 | | 3/2001 |
| JP | 2003-197586 | | 7/2003 |
| JP | 2003-257914 | | 9/2003 |
| JP | 2004-202666 | | 7/2004 |
| JP | 2004-306173 | | 11/2004 |
| JP | 2005-046947 | | 2/2005 |
| JP | 2005-203522 | | 7/2005 |
| JP | 2005-311246 | | 11/2005 |
| JP | 2006-237445 | | 9/2006 |
| JP | 2007-000968 | | 1/2007 |
| JP | 2007-035973 | | 2/2007 |
| JP | 2007-73615 | | 3/2007 |
| JP | 2007-073615 | | 3/2007 |
| JP | 2007-168039 | | 7/2007 |
| JP | 2008-137148 | | 6/2008 |
| JP | 2008-270627 | | 11/2008 |
| JP | 2008-307624 | | 12/2008 |
| JP | 2010-042487 | | 2/2010 |
| JP | 2010-245239 | | 10/2010 |
| JP | 2012-148376 | | 8/2012 |
| JP | 2013-022664 | | 2/2013 |
| JP | 2013-042066 | | 2/2013 |
| JP | 2013-099814 | | 5/2013 |
| JP | 2014-188596 | | 10/2014 |
| JP | 2015-104769 | | 6/2015 |
| JP | 2015-131361 | | 7/2015 |
| JP | 2017-536692 | A | 12/2017 |
| JP | 2018-1789 | | 1/2018 |
| JP | 2018-101738 | | 6/2018 |
| JP | 2018-187724 | | 11/2018 |
| JP | 2018-195738 | | 12/2018 |
| JP | 2019-081241 | | 5/2019 |
| KR | 10-2002-0039606 | | 5/2002 |
| KR | 10-2004-0000067 | | 1/2004 |
| KR | 10-2004-0035721 | A | 4/2004 |
| KR | 10-2006-0076332 | | 7/2006 |
| KR | 10-2008-0001523 | | 1/2008 |
| KR | 10-2009-0046468 | | 5/2009 |
| KR | 10-2012-0084671 | | 7/2012 |
| KR | 10-2013-0095626 | A | 8/2013 |
| KR | 10-2014-0014119 | A | 2/2014 |
| KR | 10-2015-0024781 | | 3/2015 |
| KR | 10-1587894 | | 1/2016 |
| KR | 10-2017-0073292 | | 6/2017 |
| KR | 10-1816694 | | 1/2018 |
| KR | 10-2018-0100741 | | 9/2018 |
| KR | 10-2020-0037557 | | 4/2020 |
| KR | 10-2020-0056015 | | 5/2020 |
| TW | 501168 | | 9/2002 |
| TW | 201729944 | | 9/2017 |
| TW | 202000368 | | 1/2020 |
| WO | WO 1990/013735 | | 11/1990 |
| WO | WO 1994/023896 | | 10/1994 |
| WO | WO 1996/014139 | | 5/1996 |
| WO | WO 2000/058054 | | 10/2000 |
| WO | WO 2002/017411 | | 2/2002 |
| WO | WO 2006/043928 | | 4/2006 |
| WO | WO 2014/113220 | | 7/2014 |
| WO | WO 2017/049763 | | 3/2017 |
| WO | WO 2018/004922 | | 1/2018 |
| WO | WO 2018/034308 | | 2/2018 |
| WO | WO 2020/005749 | | 1/2020 |

OTHER PUBLICATIONS

Banerjee et al., "Post CMP Aqueous and CO2 Cryogenic Cleaning Technologies for Low k and Copper Integration," CMPUG Symposium, Poster Abstract, Jan. 2015, 2 pages.

International Search Report and Written Opinion in International Appln. No. PCT/US2020/018736, dated Jun. 16, 2020, 12 pages.

Machine Generated English Translation of CN 207171777, Published on Apr. 3, 2018, 25 pages.

Sampurno et al., "Pad Surface Thermal Management during Copper Chemical Mechanical Planarization," Presented Oct. 1, 2015 at lie International Conference on Planarization/CMP Technology, Sep. 30, 2015-Oct. 2, 2015, Session D-4, Chandler, AZ, USA, 24 pages.

Wu et al., "Pad Surface Thermal Management during Copper Chemical: Mechanical Planarization," ECS Journal of Solid State Science and Technology, Apr. 2015, 4(7):P206-12.

Notice of Allowance in Chinese Appln. No. 202080001434.7 dated May 10, 2024, 11 pages (with English translation).

Notice of Allowance in Korean Appln. No. 10-2021-7029808, dated Dec. 12, 2024, 6 pages (with English translation).

* cited by examiner

APPARATUS AND METHOD FOR CMP TEMPERATURE CONTROL

CROSS-REFERENCE TO RELATED APPLICATIONS

This application is a continuation of U.S. application Ser. No. 16/795,103, filed on Feb. 19, 2020, which claims priority to U.S. Provisional Application Ser. No. 62/808,266, filed on Feb. 20, 2019, the disclosures of which are incorporated by reference.

TECHNICAL FIELD

The present disclosure relates to chemical mechanical polishing (CMP), and more specifically to temperature control during chemical mechanical polishing.

BACKGROUND

An integrated circuit is typically formed on a substrate by the sequential deposition of conductive, semiconductive, or insulative layers on a semiconductor wafer. A variety of fabrication processes require planarization of a layer on the substrate. For example, one fabrication step involves depositing a filler layer over a non-planar surface and planarizing the filler layer. For certain applications, the filler layer is planarized until the top surface of a patterned layer is exposed. For example, a metal layer can be deposited on a patterned insulative layer to fill the trenches and holes in the insulative layer. After planarization, the remaining portions of the metal in the trenches and holes of the patterned layer form vias, plugs, and lines to provide conductive paths between thin film circuits on the substrate. As another example, a dielectric layer can be deposited over a patterned conductive layer, and then planarized to enable subsequent photolithographic steps.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing slurry with abrasive particles is typically supplied to the surface of the polishing pad.

SUMMARY

In one aspect, a chemical mechanical polishing apparatus includes a platen to hold a polishing pad, a carrier to hold a substrate against a polishing surface of the polishing pad during a polishing process, and a temperature control system including a source of heated fluid and a plurality of openings positioned over the platen and separated from the polishing pad and configured for the heated fluid to flow onto the polishing pad.

Implementations of any of the above aspects may include one or more of the following features.

The heated fluid may include a gas, e.g., steam.

A body may extend over the platen, and the plurality of openings may be formed in a surface of the body. The openings may be disposed on the body with a non-uniform density along a radial axis of the platen.

The apparatus may have a slurry dispensing port. The openings may be disposed at a greater density at a radial zone corresponding to a radial position of the slurry dispensing port.

In another aspect, a chemical mechanical polishing apparatus includes platen to hold a polishing pad, a carrier to hold a substrate against a polishing surface of the polishing pad during a polishing process, and a temperature control system including a source of coolant fluid and a plurality of openings positioned over the platen and separated from the polishing pad and configured for the coolant fluid to flow onto the polishing pad.

Implementations of any of the above aspects may include one or more of the following features.

The plurality of openings may deliver the coolant fluid to a first region of the polishing pad. A polishing liquid dispensing system may have a port to deliver polishing liquid to a different second region of the polishing pad, a rinse system may have a port to deliver a rinsing liquid to a different third region of the polishing pad.

The coolant fluid may include a liquid, e.g., water. For example, the coolant fluid may consist of water or aerosolized water.

The coolant fluid may include a liquid and a gas. The plurality of openings may be configured to generate an aerosolized spray.

The openings may be disposed on the body with a non-uniform density along a radial axis of the platen.

One or more valves and/or pumps may control a mix ratio of the liquid and the gas in the coolant fluid delivered to the polishing pad.

In another aspect, a method of chemical mechanical polishing includes bringing a substrate into contact with a polishing pad, causing relative motion between the polishing pad and the substrate, and raising or lowering a temperature of the polishing pad by delivering a thermal control medium onto the polishing pad.

In another aspect, a chemical mechanical polishing apparatus includes a platen to hold a polishing pad, a carrier to hold a substrate against a polishing surface of the polishing pad during a polishing process, and a temperature control system including a source of a fluid medium and one or more openings positioned over the platen and separated from the polishing pad and configured for the fluid medium to flow onto the polishing pad to heat or cool the polishing pad.

One or more of the following possible advantages may be realized. Temperature of the polishing pad can be quickly and efficiently raised or lowered. The temperature of the polishing pad can be controlled without contacting the polishing pad with a solid body, e.g., a heat exchange plate, thus reducing risk of contamination of the pad and defects. Temperature variation over a polishing operation can be reduced. This can improve predictability of the polishing process. Temperature variation from one polishing operation to another polishing operation can be reduced. This can improve wafer-to-wafer uniformity and improve repeatability of the polishing process. Temperature variation across a substrate can be reduced. This can improve within-wafer uniformity.

The details of one or more implementations are set forth in the accompanying drawings and the description below. Other aspects, features, and advantages will be apparent from the description and drawings, and from the claims.

DETAILED DESCRIPTION

Figure 1:
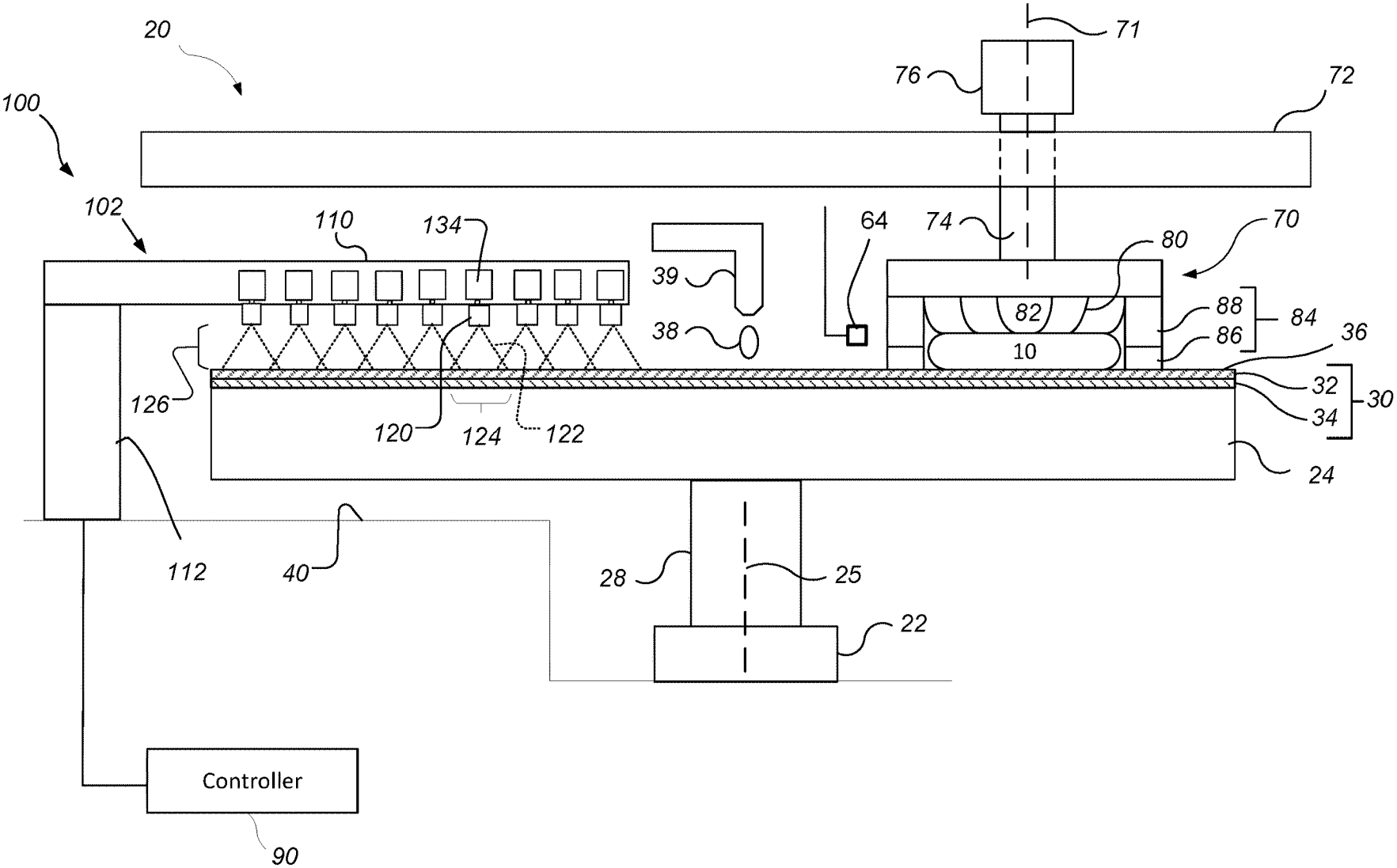
FIG. 1 illustrates a schematic cross-sectional view of an example of a polishing apparatus.

Chemical mechanical polishing operates by a combination of mechanical abrasion and chemical etching at the interface between the substrate, polishing liquid, and polishing pad. During the polishing process, a significant amount of heat is generated due to friction between the surface of the substrate and the polishing pad. In addition, some processes also include an in-situ pad conditioning step in which a conditioning disk, e.g., a disk coated with abrasive diamond particles, is pressed against the rotating polishing pad to condition and texture the polishing pad surface. The abrasion of the conditioning process can also generate heat. For example, in a typical one minute copper CMP process with a nominal downforce pressure of 2 psi and removal rate of 8000 Å/min, the surface temperature of a polyurethane polishing pad can rise by about 30° C.

Both the chemical-related variables in a CMP process, e.g., as the initiation and rates of the participating reactions, and the mechanical-related variables, e.g., the surface friction coefficient and viscoelasticity of the polishing pad, are strongly temperature dependent. Consequently, variation in the surface temperature of the polishing pad can result in changes in removal rate, polishing uniformity, erosion, dishing, and residue. By more tightly controlling the temperature of the surface of the polishing pad during polishing, variation in temperature can be reduced, and polishing performance, e.g., as measured by within-wafer non-uniformity or wafer-to-wafer non-uniformity, can be improved.

Some techniques have been proposed for temperature control. As one example, coolant could be run through the platen. As another example, a temperature of the polishing liquid delivered to the polishing pad can be controlled. However, these techniques can be insufficient. For example, the platen must supply or draw heat through the body of the polishing pad itself to control the temperature of the polishing surface. The polishing pad is typically a plastic material and a poor thermal conductor, so that thermal control from the platen can be difficult. On the other hand, the polishing liquid may not have a significant thermal mass.

A technique that could address these issues is to have a dedicated temperature control system (separate from the polishing liquid supply) that delivers a temperature-controlled medium, e.g., a liquid, vapor or spray, onto the polishing surface of the polishing pad (or the polishing liquid on the polishing pad).

An additional issue is that the temperature increase is often not uniform along the radius of the rotating polishing pad during the CMP process. Without being limited to any particular theory, different sweep profiles of the polishing head and pad conditioner sometimes can have different dwell times in each radial zone of the polishing pad. In addition, the relative linear velocity between the polishing pad and the polishing head and/or the pad conditioner also varies along the radius of the polishing pad. Moreover, the polishing liquid can act as a heat sink, cooling the polishing pad in the region to which the polishing liquid is dispensed. These effects can contribute to non-uniform heat generation on the polishing pad surface, which can result in within-wafer removal rate variations.

A technique that may address these issues is to have multiple independently controlled dispensers spaced along the radius of the polishing pad. This permits the temperature of the medium to be varied along the length of the pad, thus providing radial control of the temperature of the polishing pad. Another technique that may address these issues is to have dispenser spaced non-uniformly along the radius of the polishing pad.

Figure 2:
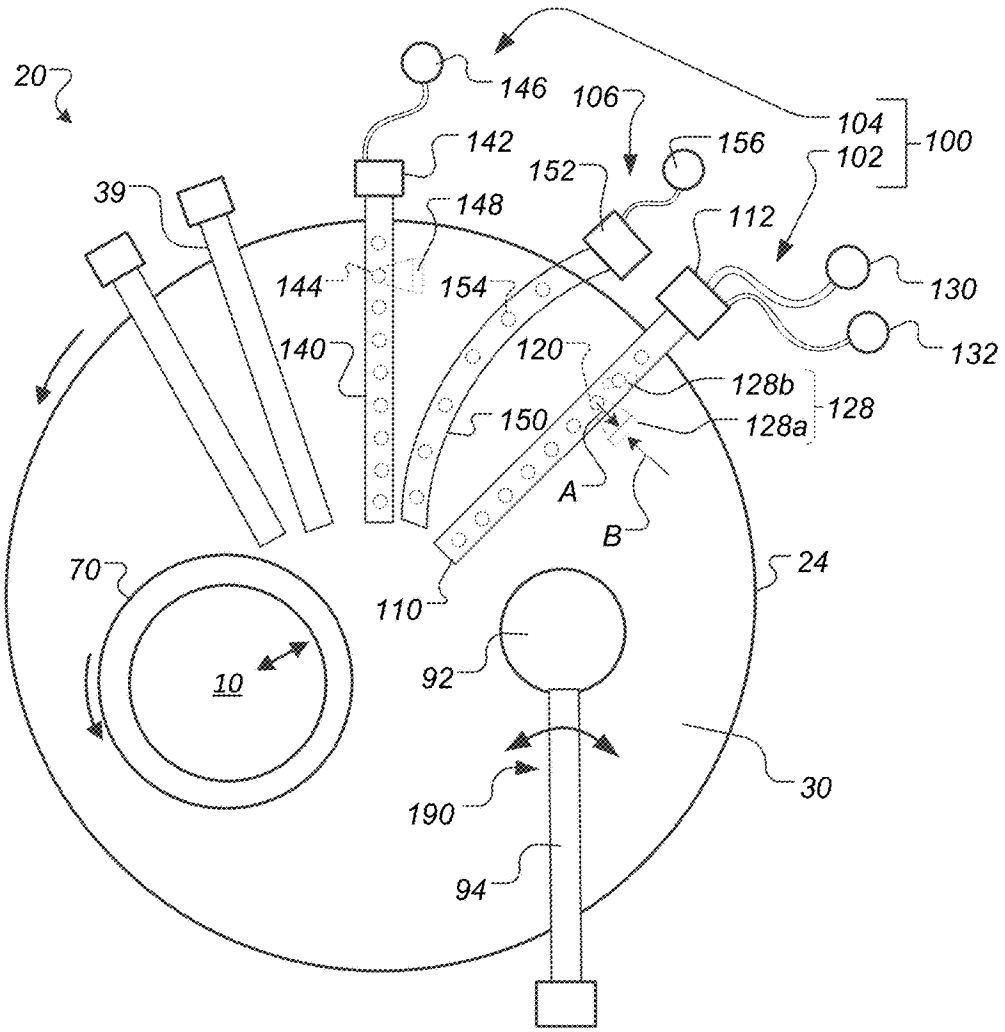
FIG. 2 illustrates a schematic top view of an example chemical mechanical polishing apparatus.
Figure 3:
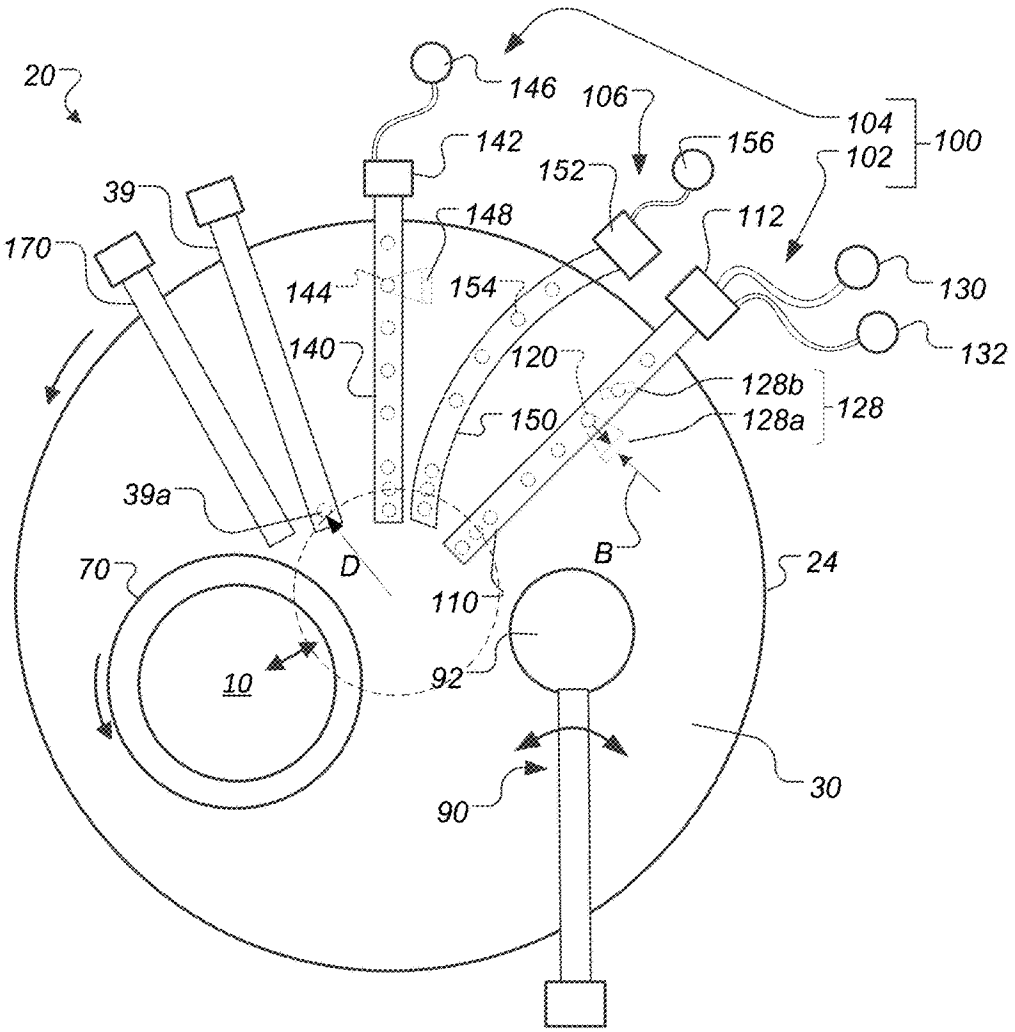
FIG. 3 illustrates a schematic top view of an example chemical mechanical polishing apparatus.

FIGS. 1 and 2 illustrate an example of a polishing station 20 of a chemical mechanical polishing system. The polishing station 20 includes a rotatable disk-shaped platen 24 on which a polishing pad 30 is situated. The platen 24 is operable to rotate (see arrow A in FIG. 2) about an axis 25. For example, a motor 22 can turn a drive shaft 28 to rotate the platen 24. The polishing pad 30 can be a two-layer polishing pad with an outer polishing layer 32 and a softer backing layer 34.

The polishing station 20 can include a supply port, e.g., at the end of a slurry supply arm 39, to dispense a polishing liquid 38, such as an abrasive slurry, onto the polishing pad 30. The polishing station 20 can include a pad conditioner apparatus 190 with a conditioning disk 92 (see FIG. 2) to maintain the surface roughness of the polishing pad 30. The conditioning disk 92 can be positioned at the end of an arm 94 that can swing so as to sweep the disk 92 radially across the polishing pad 30.

A carrier head 70 is operable to hold a substrate 10 against the polishing pad 30. The carrier head 70 is suspended from a support structure 72, e.g., a carousel or a track, and is connected by a drive shaft 74 to a carrier head rotation motor 76 so that the carrier head can rotate about an axis 71. Optionally, the carrier head 70 can oscillate laterally, e.g., on sliders on the carousel, by movement along the track, or by rotational oscillation of the carousel itself.

The carrier head 70 can include a retaining ring 84 to hold the substrate. In some implementations, the retaining ring 84 may include a lower plastic portion 86 that contacts the polishing pad, and a upper portion 88 of a harder material.

In operation, the platen is rotated about its central axis 25, and the carrier head is rotated about its central axis 71 and translated laterally across the top surface of the polishing pad 30.

The carrier head 70 can include a flexible membrane 80 having a substrate mounting surface to contact the back side of the substrate 10, and a plurality of pressurizable chambers 82 to apply different pressures to different zones, e.g., different radial zones, on the substrate 10. The carrier head can also include a retaining ring 84 to hold the substrate.

In some implementations, the polishing station 20 includes a temperature sensor 64 to monitor a temperature in the polishing station or a component of/in the polishing station, e.g., the temperature of the polishing pad and/or slurry on the polishing pad. For example, the temperature sensor 64 could be an infrared (IR) sensor, e.g., an IR camera, positioned above the polishing pad 30 and configured to measure the temperature of the polishing pad 30 and/or slurry 38 on the polishing pad. In particular, the temperature sensor 64 can be configured to measure the temperature at multiple points along the radius of the polishing pad 30 in order to generate a radial temperature profile. For example, the IR camera can have a field of view that spans the radius of the polishing pad 30.

In some implementations, the temperature sensor is a contact sensor rather than a non-contact sensor. For example, the temperature sensor 64 can be thermocouple or IR thermometer positioned on or in the platen 24. In addition, the temperature sensor 64 can be in direct contact with the polishing pad.

In some implementations, multiple temperature sensors could be spaced at different radial positions across the polishing pad 30 in order to provide the temperature at multiple points along the radius of the polishing pad 30. This technique could be use in the alternative or in addition to an IR camera.

Although illustrated in FIG. 1 as positioned to monitor the temperature of the polishing pad 30 and/or slurry 38 on the pad 30, the temperature sensor 64 could be positioned inside the carrier head 70 to measure the temperature of the substrate 10. The temperature sensor 64 can be in direct contact (i.e., a contacting sensor) with the semiconductor wafer of the substrate 10. In some implementations, multiple temperature sensors are included in the polishing station 22, e.g., to measure temperatures of different components of/in the polishing station.

The polishing system 20 also includes a temperature control system 100 to control the temperature of the polishing pad 30 and/or slurry 38 on the polishing pad. The temperature control system 100 can include a cooling system 102 and/or a heating system 104. At least one, and in some implementations both, of the cooling system 102 and heating system 104 operate by delivering a temperature-controlled medium, e.g., a liquid, vapor or spray, onto the polishing surface 36 of the polishing pad 30 (or onto a polishing liquid that is already present on the polishing pad).

For the cooling system 102, the cooling medium can be a gas, e.g., air, or a liquid, e.g., water. The medium can be at room temperature or chilled below room temperature, e.g., at 5-15° C. In some implementations, the cooling system 102 uses a spray of air and liquid, e.g., an aerosolized spray of liquid, e.g., water. In particular, the cooling system can have nozzles that generate an aerosolized spray of water that is chilled below room temperature. In some implementations, solid material can be mixed with the gas and/or liquid. The solid material can be a chilled material, e.g., ice, or a material that absorbs heat, e.g., by chemical reaction, when dissolved in water.

The cooling medium can be delivered by flowing through one or more apertures, e.g., holes or slots, optionally formed in nozzles, in a coolant delivery arm. The apertures can be provided by a manifold that is connected to a coolant source.

As shown in FIGS. 1 and 2, an example cooling system 102 includes an arm 110 that extends over the platen 24 and polishing pad 30 from an edge of the polishing pad to or at least near (e.g., within 5% of the total radius of the polishing pad) the center of polishing pad 30. The arm 110 can be supported by a base 112, and the base 112 can be supported on the same frame 40 as the platen 24. The base 112 can include one or more an actuators, e.g., a linear actuator to raise or lower the arm 110, and/or a rotational actuator to swing the arm 110 laterally over the platen 24. The arm 110 is positioned to avoid colliding with other hardware components such as the polishing head 70, pad conditioning disk 92, and the slurry dispensing arm 39.

The example cooling system 102 includes multiple nozzles 120 suspended from the arm 110. Each nozzle 120 is configured to spray a liquid coolant medium, e.g., water, onto the polishing pad 30. The arm 110 can be supported by a base 112 so that the nozzles 120 are separated from the polishing pad 30 by a gap 126.

Each nozzle 120 can be configured to direct aerosolized water in a spray 122 toward the polishing pad 30. The cooling system 102 can include a source 130 of liquid coolant medium and a gas source 132 (see FIG. 2). Liquid from the source 130 and gas from the source 132 can be mixed in a mixing chamber 134 (see FIG. 1), e.g., in or on the arm 110, before being directed through the nozzle 120 to form the spray 122.

In some implementations, a process parameter, e.g., flow rate, pressure, temperature, and/or mixing ratio of liquid to gas, can be independently controlled for each nozzle. For example, the coolant for each nozzle 120 can flow through an independently controllable chiller to independently control the temperature of the spray. As another example, a separate pair of pumps, one for the gas and one for the liquid, can be connected to each nozzle such that the flow rate, pressure and mixing ratio of the gas and liquid can be independently controlled for each nozzle.

The various nozzles 120 can spray onto different radial zones 124 on the polishing pad 30. Adjacent radial zones 124 can overlap. In some implementations, the nozzles 120 generate a spray impinges the pad 30 along elongated regions 128. For example, the nozzles 120 can be configured to generate a spray in a generally planar triangular volume.

One or more of the elongated regions 128, e.g., all of the elongated regions 128, can have a longitudinal axis parallel to the radius that extends through the elongated regions 128 (see region 128*a*). Alternatively, the nozzles 120 generate a conical spray.

Although FIG. 1 illustrates the spray itself overlapping, the nozzles 120 can be 25 oriented so that the elongated regions 128 do not overlap. For example, at least some nozzles 120, e.g., all of the nozzles 120, can be oriented so that the elongated regions 128 are at oblique angles relative to the radius that passes through the elongated regions 128 (see region 128*b*).

At least some nozzles 120 can be oriented so that a central axis of the spray (see 30 arrow A) from that nozzle is at an oblique angle relative to the polishing surface 36. In particular, spray 122 can be directed from a nozzle 120 to have a horizontal component in a direction opposite to the direction of motion of polishing pad 30 (see arrow B) in the region of impingement caused by rotation of the platen 24, e.g., region 128*a*.

Although FIGS. 1 and 2 illustrate the nozzles 120 as spaced at uniform intervals, this is not required. The nozzles 120 could be distributed non-uniformly either radially, or angularly, or both. For example, the nozzles 120 can clustered more densely along the radial direction toward the edge of the polishing pad 30. In addition, although FIGS. 1 and 2 illustrate nine nozzles, there could be a larger or smaller number of nozzles, e.g., three to twenty nozzles.

For the heating system 104, the heating medium can be a gas, e.g., steam or heated air, or a liquid, e.g., heated water, or a combination of gas and liquid. The medium is above room temperature, e.g., at 40-120° C., e.g., at 90-110° C. The medium can be water, such as substantially pure deionized water, or water that that includes additives or chemicals. In some implementations, the heating system 104 uses a spray of steam. The steam can includes additives or chemicals.

The heating medium can be delivered by flowing through apertures, e.g., holes or slots, e.g., provided by one or more nozzles, on a heating delivery arm. The apertures can be provided by a manifold that is connected to a source of the heating medium.

An example heating system 104 includes an arm 140 that extends over the platen 24 and polishing pad 30 from an edge of the polishing pad to or at least near (e.g., within 5% of the total radius of the polishing pad) the center of polishing pad 30. The arm 140 can be supported by a base 142, and the base 142 can be supported on the same frame 40 as the platen 24. The base 142 can include one or more an actuators, e.g., a linear actuator to raise or lower the arm 140, and/or a rotational actuator to swing the arm 140 laterally over the platen 24. The arm 140 is positioned to avoid colliding with other hardware components such as the polishing head 70, pad conditioning disk 92, and the slurry dispensing arm 39.

Along the direction of rotation of the platen 24, the arm 140 of the heating system 104 can be positioned between the arm 110 of the cooling system 102 and the carrier head 70. Along the direction rotation of the platen 24, the arm 140 of the heating system 104 can be positioned between the arm 110 of the cooling system 102 and the slurry delivery arm 39. For example, the arm 110 of the cooling system 102, the arm 140 of the heating system 104, the slurry delivery arm 39 and the carrier head 70 can be positioned in that order along the direction rotation of the platen 24.

Multiple openings 144 are formed in the bottom surface of the arm 140. Each opening 144 is configured to direct a gas or vapor, e.g., steam, onto the polishing pad 30. The arm 140 can be supported by a base 142 so that the openings 144 are separated from the polishing pad 30 by a gap. The gap can be 0.5 to 5 mm. In particular, the gap can be selected such that the heat of the heating fluid does not significantly dissipate before the fluid reaches the polishing pad. For example, the gap can be selected such that steam emitted from the openings does not condense before reaching the polishing pad.

The heating system 104 can include a source 146 of steam, which can be connected to the arm 140 by tubing. Each opening 144 can be configured to direct steam toward the polishing pad 30.

In some implementations, a process parameter, e.g., flow rate, pressure, temperature, and/or mixing ratio of liquid to gas, can be independently controlled for each nozzle. For example, the fluid for each opening 144 can flow through an independently controllable heater to independently control the temperature of the heating fluid, e.g., the temperature of the steam.

The various openings 144 can direct steam onto different radial zones on the polishing pad 30. Adjacent radial zones can overlap. Optionally, some of the openings 144 can be oriented so that a central axis of the spray from that opening is at an oblique angle relative to the polishing surface 36. Steam can be directed from one or more of the openings 144 to have a horizontal component in a direction opposite to the direction of motion of polishing pad 30 in the region of impingement as caused by rotation of the platen 24.

Although FIG. 2 illustrates the openings 144 as spaced at even intervals, this is not required. The nozzles 120 could be distributed non-uniformly either radially, or angularly, or both. For example, openings 144 could be clustered more densely toward the center of the polishing pad 30. As another example, openings 144 could be clustered more densely at a radius corresponding to a radius at which the polishing liquid 38 is delivered to the polishing pad 30 by the slurry delivery arm 39. In addition, although FIG. 2 illustrates nine openings, there could be a larger or smaller number of openings.

The polishing system 20 can also include a high pressure rinse system 106. The high pressure rinse system 106 includes a plurality of nozzles 154, e.g., three to twenty nozzles, that direct a cleaning fluid, e.g., water, at high intensity onto the polishing pad 30 to wash the pad 30 and remove used slurry, polishing debris, etc.

As shown in FIG. 2, an example rinse system 106 includes an arm 150 that extends over the platen 24 and polishing pad 30 from an edge of the polishing pad to or at least near (e.g., within 5% of the total radius of the polishing pad) the center of polishing pad 30. The arm 150 can be supported by a base 152, and the base 152 can be supported on the same frame 40 as the platen 24. The base 152 can include one or more an actuators, e.g., a linear actuator to raise or lower the arm 150, and/or a rotational actuator to swing the arm 150 laterally over the platen 24. The arm 150 is positioned to avoid colliding with other hardware components such as the polishing head 70, pad conditioning disk 92, and the slurry dispensing arm 39.

Along the direction of rotation of the platen 24, the arm 150 of the rinse system 106 can be between the arm 110 of the cooling system 102 and the arm 140 of the heating system 104. For example, the arm 110 of the cooling system 102, the arm 150 of the rinse system 106, the arm 140 of the heating system 104, the slurry delivery arm 39 and the carrier head 70 can be positioned in that order along the direction rotation of the platen 24. Alternatively, along the direction of rotation of the platen 24, the arm 140 of the cooling system 102 can be between the arm 150 of the rinse system 106 and the arm 140 of the heating system 104. For example, the arm 150 of the rinse system 106, the arm 110 of the cooling system 102, the arm 140 of the heating system 104, the slurry delivery arm 39 and the carrier head 70 can be positioned in that order along the direction rotation of the platen 24.

Multiple nozzles 154 are suspended from the arm 150. Each nozzle 150 is configured to spray a cleaning liquid at high pressure onto the polishing pad 30. The arm 150 can be supported by a base 152 so that the nozzles 120 are separated from the polishing pad 30 by a gap. The rinsing system 106 can include a source 156 of cleaning fluid, which can be connected to the arm 150 by tubing.

The various nozzles 154 can spray onto different radial zones on the polishing pad 30. Adjacent radial zones can overlap. In some implementations, the nozzles 154 are oriented so that the regions of impingement of the cleaning liquid on the polishing pad do not overlap. For example, at least some nozzles 154 can be position and oriented so that regions of impingement are angularly separated.

At least some nozzles 154 can be oriented so that a central axis of the spray from that nozzle is at an oblique angle relative to the polishing surface 36. In particular, the cleaning fluid can be sprayed from each nozzle 154 to with horizontal component that is radially outward (toward the edge of the polishing pad). This can cause the cleaning fluid to slough off the pad 30 more quickly, and leave a thinner region of fluid on the polishing pad 30. This can thermal coupling between the heating and/or cooling media and the polishing pad 30.

Although FIG. 2 illustrate the nozzles 154 as spaced at even intervals, this is not required. In addition, although FIGS. 1 and 2 illustrate nine nozzles, there could be a larger or smaller number of nozzles, e.g., three to twenty nozzles.

The polishing system 20 can also include a controller 90 to control operation of various components, e.g., the temperature control system 100. The controller 90 is configured to receive the temperature measurements from the temperature sensor 64 for each radial zone of the polishing pad. The controller 90 can compare the measured temperature profile to a desired temperature profile, and generate a feedback signal to a control mechanism (e.g., actuator, power source, pump, valve, etc.) for each nozzle or opening. The feedback signal is calculated by the controller 90, e.g., based on an internal feedback algorithm, to cause the control mechanism to adjust the amount of cooling or heating such that the polishing pad and/or slurry reaches (or at least moves closer to) the desired temperature profile.

FIG. 2 illustrates separate arms for each subsystem, e.g., the heating system 104, cooling system 102 and rinse system 106, various subsystems can be included in a single assembly supported by a common arm. For example, an assembly can include a cooling module, a rinse module, a heating module, a slurry delivery module, and optionally a wiper module. Each module can include a body, e.g., an arcuate body, that can be secured to a common mounting plate, and the common mounting plate can be secured at the end of an arm so that the assembly is positioned over the polishing pad 30. Various fluid delivery components, e.g., tubing, passages, etc., can extend inside each body. In some implementations, the modules are separately detachable from the mounting plate. Each module can have similar components to carry out the functions of the arm of the associated system described above.

The above described polishing apparatus and methods can be applied in a variety of polishing systems. Either the polishing pad, or the carrier heads, or both can move to provide relative motion between the polishing surface and the substrate. For example, the platen may orbit rather than rotate. The polishing pad can be a circular (or some other shape) pad secured to the platen. The polishing layer can be a standard (for example, polyurethane with or without fillers) polishing material, a soft material, or a fixed-abrasive material.

Terms of relative positioning are used to refer to relative positioning within the system or substrate; it should be understood that the polishing surface and substrate can be held in a vertical orientation or some other orientation during the polishing operation.

Functional operations of the controller 90 can be implemented using one or more computer program products, i.e., one or more computer programs tangibly embodied in a non-transitory computer readable storage media, for execution by, or to control the operation of, data processing apparatus, e.g., a programmable processor, a computer, or multiple processors or computers.

A number of embodiments of the invention have been described. Nevertheless, it will be understood that various modifications may be made without departing from the spirit and scope of the invention.

For example, although the description above focuses on delivering the heating and/or cooling medium onto the polishing pad, the heating and/or cooling medium could be delivered onto other components to control the temperature of those components. For example, a heating and/or cooling medium could be sprayed onto the substrate while the substrate is positioned in a transfer station, e.g., in a load cup. As another example, the load cup itself could be sprayed with the heating and/or cooling medium. As yet another example, the conditioning disk could be sprayed with the heating and/or cooling medium.

Accordingly, other embodiments are within the scope of the following claims.

What is claimed is:

1. A chemical mechanical polishing apparatus comprising:

a platen to hold a polishing pad;

a carrier head to hold a substrate against a polishing surface of the polishing pad during a polishing process;

a polishing liquid dispenser including a first port positioned over the platen to deliver polishing liquid onto a first region of the polishing pad;

a rinse system including a second port positioned over the platen to deliver a rinsing liquid to a second region of the polishing pad to clean the polishing pad; and a temperature control system including a source of heated gas and a manifold including a plurality of openings positioned over the platen and separated from the polishing pad and configured for the heated gas to flow directly from the plurality of openings onto a third region of the polishing pad, wherein the openings are disposed with a non-uniform spacing along a radial axis of the platen, and wherein the first region, the second region, and the third region are different than each other.

2. The apparatus of claim 1, wherein the heated gas comprises steam.

3. The apparatus of claim 1, wherein the openings are disposed such that the heated gas is dispensed in zones that overlap along a radial axis of the platen.

4. The apparatus of claim 1, and wherein a portion of the openings at a radial zone on the platen corresponding to a radial position of the first port are disposed at a smaller spacing than the remaining openings not at the radial zone.

5. The apparatus of claim 1, wherein at least one opening of the plurality of openings is configured such that a central axis of a spray of the heated gas from the at least one opening of the plurality of openings is at an oblique angle relative to the polishing surface.

6. The apparatus of claim 5, wherein the at least one opening of the plurality of openings is configured such that the heated gas is directed from the at least one opening of the plurality of openings onto the polishing surface with a horizontal component of motion in a direction opposite to the direction of motion of polishing pad in a region of impingement of the heated gas on the polishing surface.

7. The apparatus of claim 1, wherein the plurality of openings are separated from the polishing pad by a gap of 0.5 to 5 mm.

8. The apparatus of claim 1, comprising a motor to rotate the platen in a direction of rotation during a polishing operation, and wherein second region is located between the carrier head and the third region along the direction of rotation.

9. The apparatus of claim 1, comprising a temperature sensor and a controller configured to receive temperature measurements from the temperature sensor and to control the temperature control system to drive the polishing pad to a desired temperature.

* * * * *